US007699551B2

(12) United States Patent
Suda et al.

(10) Patent No.: US 7,699,551 B2
(45) Date of Patent: Apr. 20, 2010

(54) CLEANING DEVICE WITH SQUIRTER

(75) Inventors: Tomokazu Suda, Kagawa (JP); Yoshinori Tanaka, Kagawa (JP); Masatoshi Fujiwara, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 139 days.

(21) Appl. No.: 11/124,100

(22) Filed: May 9, 2005

(65) Prior Publication Data

US 2005/0271456 A1 Dec. 8, 2005

(30) Foreign Application Priority Data

Jun. 3, 2004 (JP) ..... 2004-166286

(51) Int. Cl.
*A47L 13/26* (2006.01)

(52) U.S. Cl. ..... 401/139; 401/138; 401/140; 401/270

(58) Field of Classification Search ..... 401/140, 401/270–276, 137–139; 222/478, 481, 481.1, 222/481.5

See application file for complete search history.

(56) References Cited

U.S. PATENT DOCUMENTS

| | | | | |
|---|---|---|---|---|
| 1,906,991 | A | 5/1933 | McTernan | |
| 3,558,054 | A | 1/1971 | Ragot | |
| 5,477,583 | A | 12/1995 | Deloe | |
| 6,497,525 | B1 * | 12/2002 | Huang | 401/138 |
| 2005/0254882 | A1 * | 11/2005 | Hofte et al. | 401/140 |

FOREIGN PATENT DOCUMENTS

| | | | |
|---|---|---|---|
| EP | 0-913-301 | A2 | 5/1999 |
| JP | 3094858 | | 4/2003 |
| WO | WO-03/094689 | A1 | 11/2003 |
| WO | WO-2004/021850 | A2 | 3/2004 |

* cited by examiner

*Primary Examiner*—Tuan N Nguyen
(74) *Attorney, Agent, or Firm*—Morrison & Foerster LLP

(57) ABSTRACT

Disclosed is a cleaning device with a squirter for squirting liquid forward of a cleaning head. The cleaning head has a nozzle head with a nozzle. A liquid receiving part is provided to extend from beneath an orifice of the nozzle toward a front face of the cleaning head. Liquid dripping from the orifice of the nozzle can be led down an inclined top face of the liquid receiving part to the outside of the cleaning head, preventing the cleaning head from being soiled with a detergent, a wax or the like.

12 Claims, 7 Drawing Sheets

CLEANING DEVICE WITH SQUIRTER

BACKGROUND OF THE INVENTION

1. Field of the Invention

The present invention relates to a cleaning device suitable for cleaning a floor surface of a house, an office, etc., and more particularly to a cleaning device with a squirter for squirting liquid toward an object to be cleaned such as a floor surface.

2. Description of the Related Art

Japanese Utility-Model Registration No. 3094858 discloses a cleaning device having a mop section at one end of a handle constructed by connecting pipes together. The mop section has nozzles and the handle is equipped with a water container. The handle has a handle switch in its grip. By operating the handle switch, a piston provided in the water container is moved to squirt water out of the water container through the nozzles. This utility-model is aimed at improving the effect of cleaning the floor by squirting water from the nozzles.

Japanese Utility-Model Registration No. 3094858 does not specify the construction around the nozzles through which water is squirted, but squirting water through the nozzles provided in the mop section has the following problems.

FIG. 8 is a plan view showing a nozzle head (or liquid jetting part) 2 mounted on a mop section 1 that is similar to the mop section disclosed in Japanese Utility-Model Registration No. 3094858. A plurality of nozzles 3, 4, 5 have orifices on the nozzle head 2 and squirt directions of the nozzles 3, 4, 5 are indicated by La, Lb, Lc, respectively.

When water is squirted out from the nozzle head 2 mounted on the mop section 1, as shown in FIG. 1, streams of water may flow down from the orifices of the nozzles 3, 4, 5 and drip onto the mop section 1 or the water may adhere to a squirt surface 2*a* of the nozzle head 2 to cause pools 6, which tend to drip onto the mop section 1. Particularly in Japanese Utility-Model Registration No. 3094858, the flow rate of water squirted from the nozzles 3, 4, 5 decreases as the remaining amount of water in the water container decreases, which results in dripping of water onto the mop section 1.

Moreover, if liquid to be squirted out from the nozzles 3, 4, 5 is not plain water but contains a detergent or a high gloss wax, liquid that has pooled beneath the orifices of the nozzles 3, 4, 5 tends not only to soil the mop section 1 and but also to interfere with subsequent squirt of liquid from the nozzles 3, 4, 5.

Furthermore, if the mop section is constructed of a holder to which the handle is connected and an elastic pad secured beneath the holder, the liquid dripping from the nozzles 3, 4, 5 may be trapped in a boundary between the holder and the pad and then spread along the boundary because of capillary action with a results that the detergent or wax adheres to the mop section and is difficult to remove.

SUMMARY OF THE INVENTION

The present invention has been developed to solve the problems in the prior art set forth above and has an object to provide a cleaning device in which liquid dripping from a nozzle of a liquid jetting part or splattered around the nozzle can be directed to the outside of a cleaning head to thereby prevent the cleaning head from being soiled with liquid.

According to the invention, there is provided a cleaning device comprising: a cleaning head whose bottom face functions as a cleaning part; a handle supporting the cleaning head; and a squirter for squirting out liquid, the squirter including a liquid jetting part mounted on the cleaning head and a liquid supply part for supplying liquid to the liquid jetting part, the liquid jetting part having a nozzle for squirting out liquid beyond a front face of the cleaning head and a liquid receiving part extending toward the front face of the cleaning head from beneath an orifice of the nozzle, wherein the liquid receiving part has a top face which is inclined to gradually approach the cleaning part with distance from the orifice of the nozzle.

In the cleaning device according to the present invention, liquid dripping from the nozzle orifice of the liquid jetting part can be directed down the inclined top face of the liquid receiving part toward the front face of the cleaning head. Liquid that has reached a front end of the top face may be applied to and absorbed by a cleaning sheet attached to the cleaning head.

Preferably, the liquid receiving part has wall panels on both sides of a squirt direction of the nozzle, the wall panels rising upward from the top face and extending toward the front face of the cleaning head. With the wall panels, liquid laterally sprayed from the nozzle can be blocked and directed to the top face of the liquid receiving part.

According to one embodiment of the present invention, the liquid jetting part may have a plurality of nozzles fanning out to have squirt directions within an angular range, and the top face of the liquid receiving part may stretch beyond the angular range of the squirt directions. With this construction, even if streams of liquid, which are squirted out from the nozzles in different directions, fall on the cleaning head, they can be received by the liquid receiving part.

In this case, it is preferred that the liquid receiving part has wall panels outside the angular range of the squirt directions, the wall panels rising upward from the top face and extending toward the front face of the cleaning head, a distance between the wall panels increasing with distance toward the front face of the cleaning head.

According to one embodiment of the present invention, the cleaning head may have a holder to which the handle is attached and a pad which is secured beneath the holder to provide the cleaning part. According to this embodiment, the boundary between the holder and the pad is visible on the front face of the cleaning head and the liquid receiving part has a front face which extends beyond the boundary toward the cleaning part. The front face of the liquid receiving part may be inclined to come closer to the cleaning part with distance from the orifice of the nozzle and project outward from the holder. With this construction, liquid flowing down the top face and the front face of the liquid receiving part toward the front face of the cleaning head can be prevented from being trapped in the boundary between the holder and the pad.

According to one embodiment of the present invention, the liquid supply part may include a liquid retention part located above the liquid jetting part, a liquid passage connecting the liquid retention part and the liquid jetting part, and an interrupting mechanism for interrupting liquid supply from the liquid retention part to the liquid jetting part, wherein when the interrupting mechanism permits liquid passage, liquid retained in the liquid retention part squirts out of the nozzle under force of gravity. In the case where the squirter is constructed to squirt the liquid under force of gravity, both the flow volume and the flow rate decrease as the remaining liquid in the liquid retention part decreases, which tends to cause dripping of liquid from the nozzle orifice. With the liquid receiving part, however, the liquid dripping from the nozzle orifice can be led to the front face of the cleaning head.

Alternatively, the squirter may be constructed to squirt liquid out of the nozzle by a force exerted by a motor or a hand pump.

According to one embodiment of the present invention, the cleaning head may be constructed to permit removable attachment of a cleaning sheet to the cleaning part.

However, the present invention may also be applicable to a cleaning device whose cleaning head does not permit removable attachment of a cleaning sheet.

According to the present invention, as has been described above, liquid dripping or splattered from the nozzle orifice can be received by the liquid receiving part and directed to the front face of the cleaning head, which effectively prevents the cleaning head from being soiled with the liquid.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
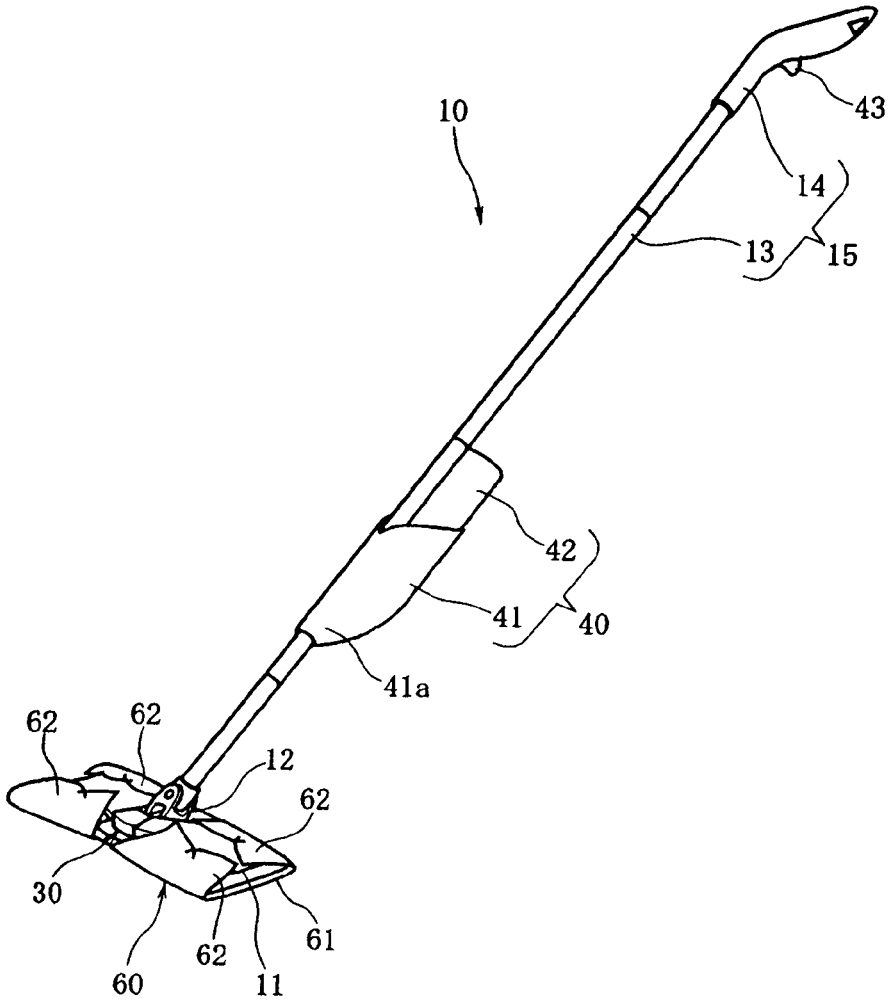
FIG. 1 is a perspective view of a cleaning device according to a first embodiment of the present invention.
Figure 2:
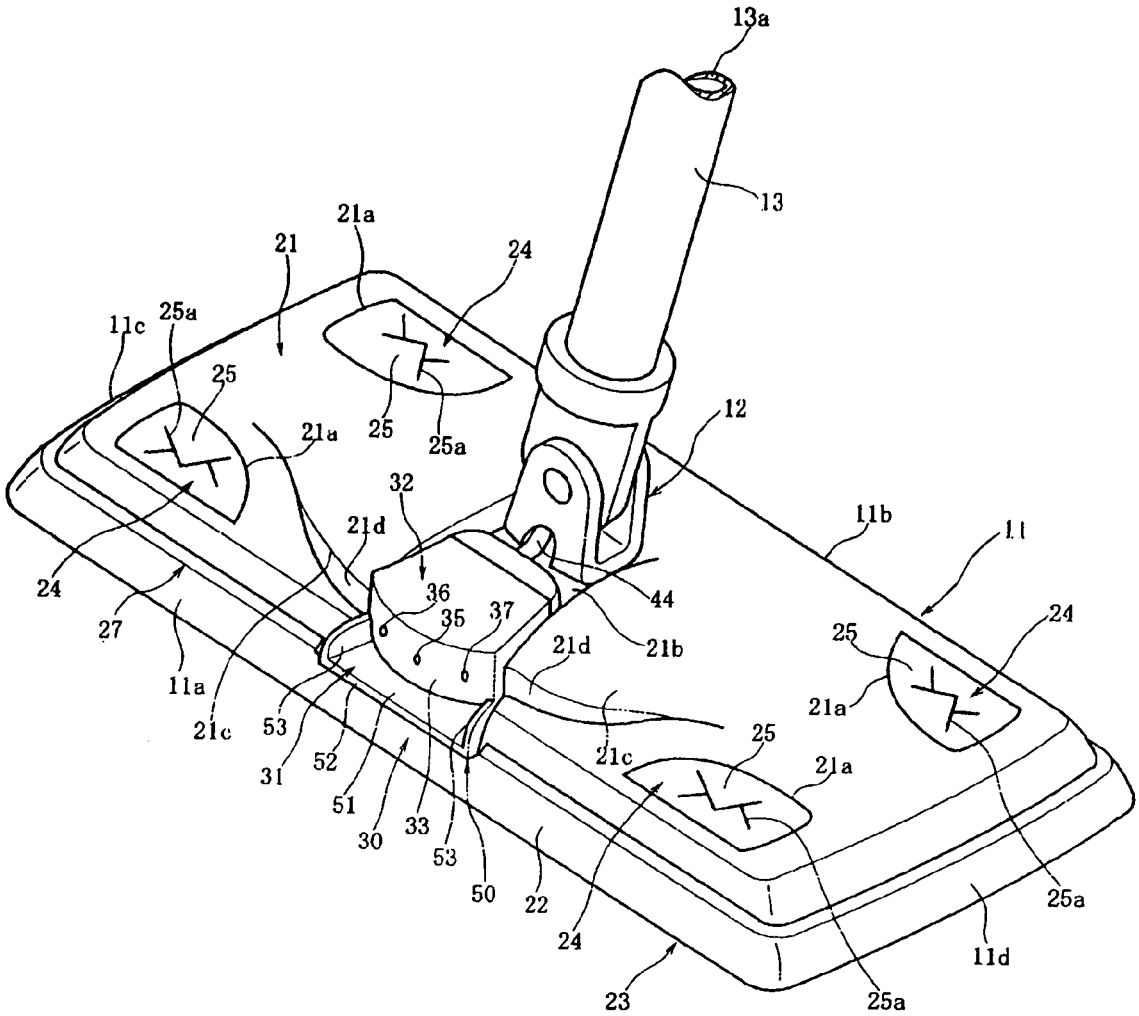
FIG. 2 is an enlarged perspective view showing a cleaning head.
Figure 3:
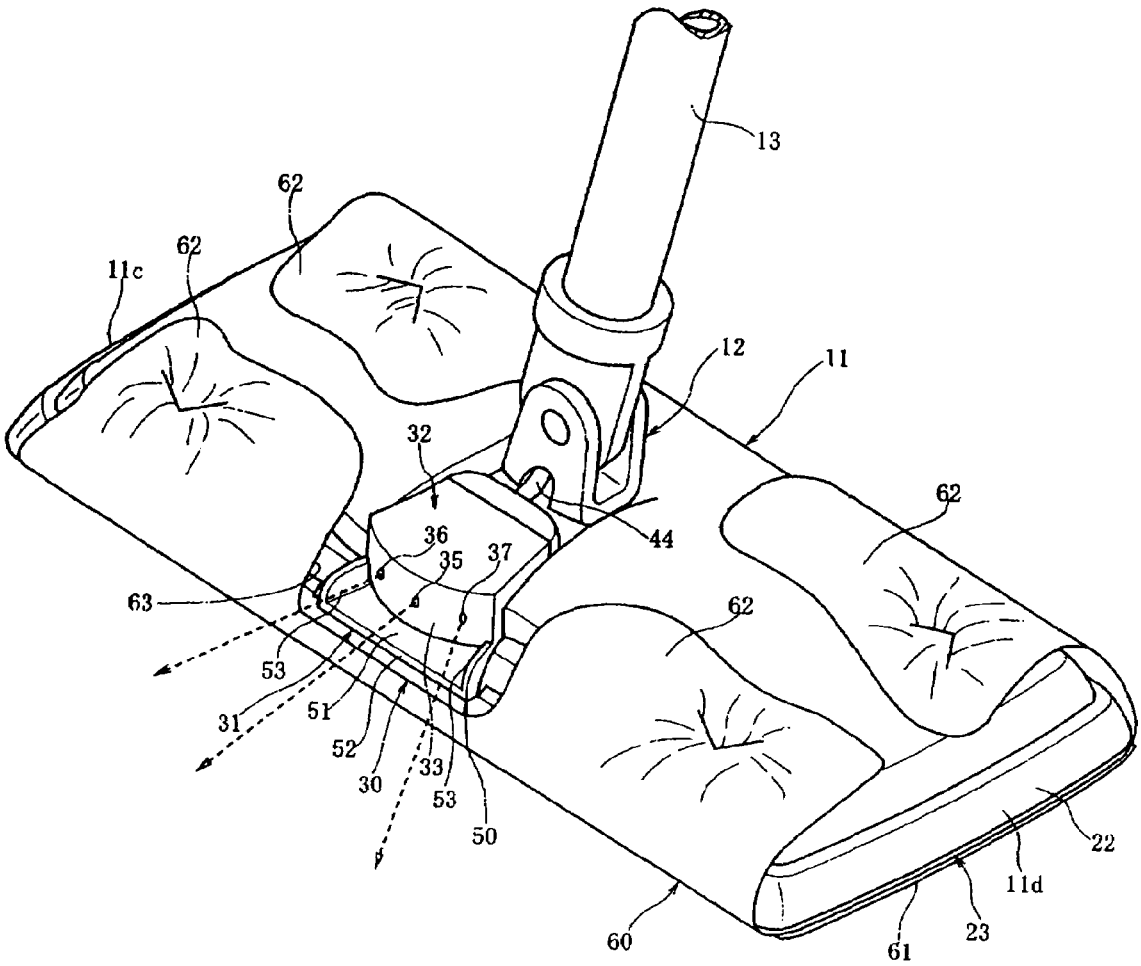
FIG. 3 is a perspective view showing a state where a disposable cleaning sheet is removably attached to the cleaning head.
Figure 4:
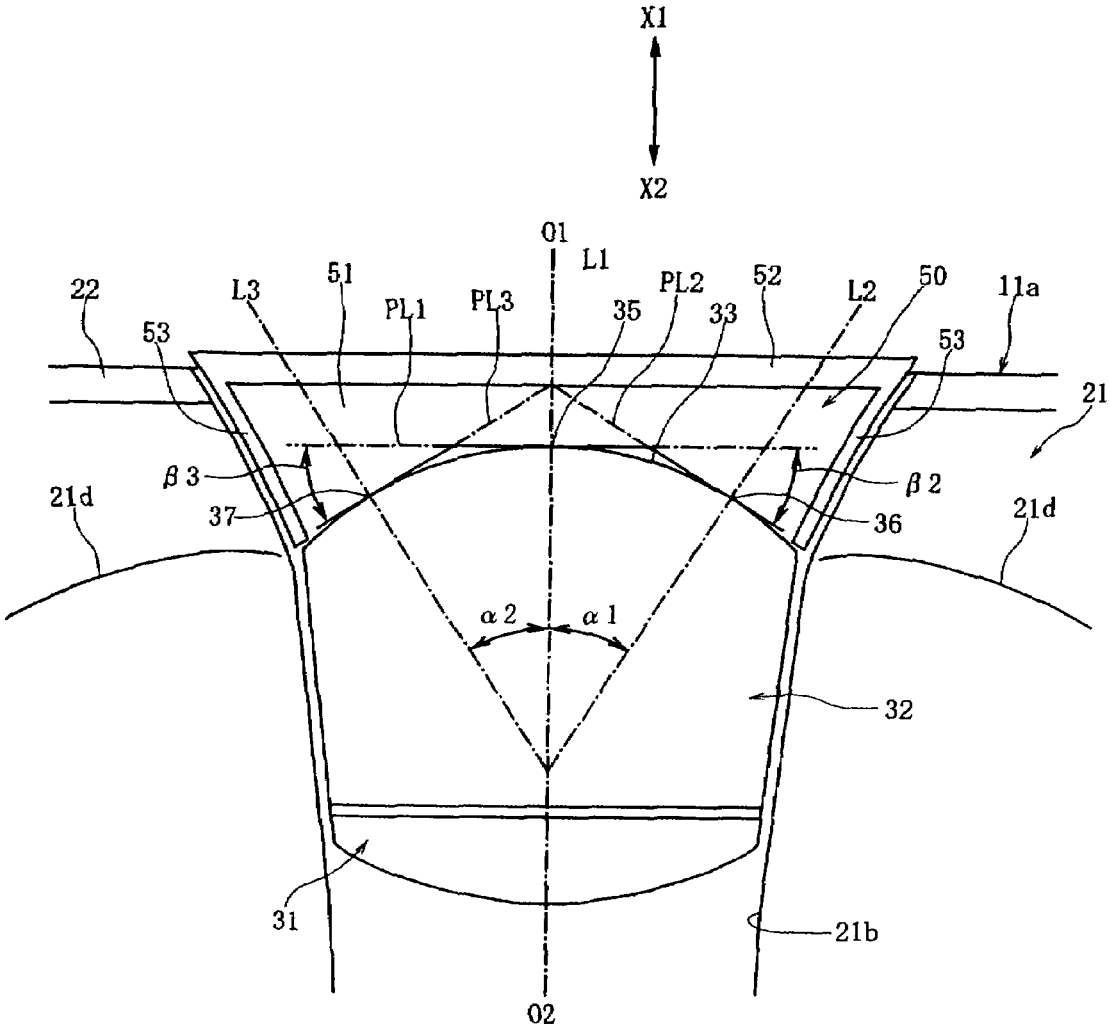
FIG. 4 is an enlarged plan view showing a liquid jetting part mounted on the cleaning head.
Figure 5:
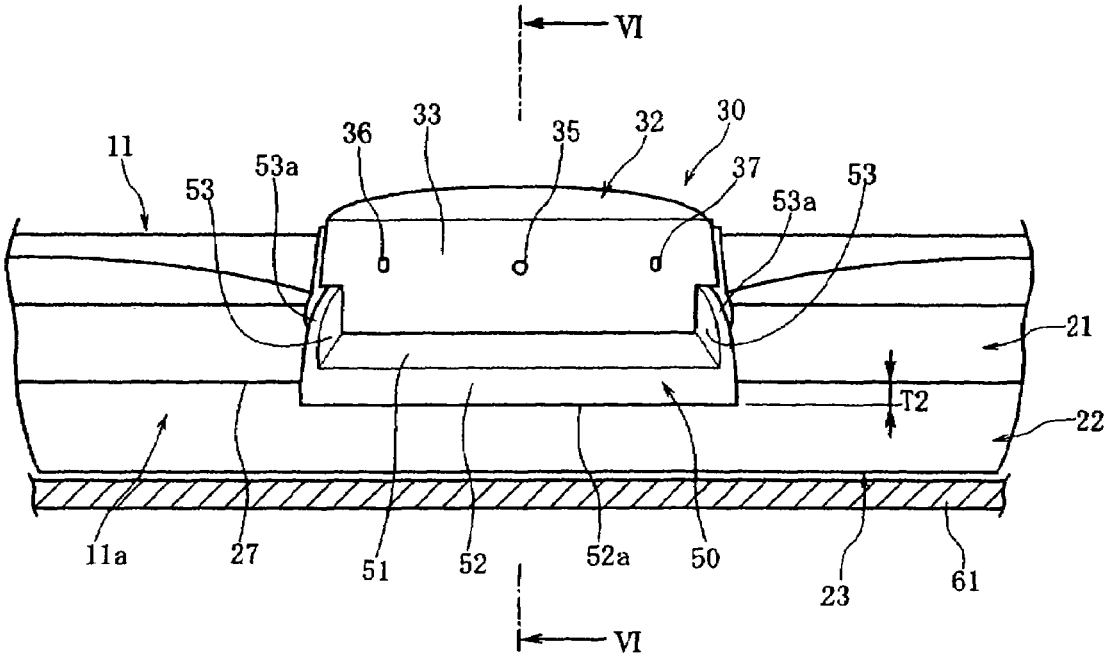
FIG. 5 is a front view of the liquid jetting part.
Figure 6:
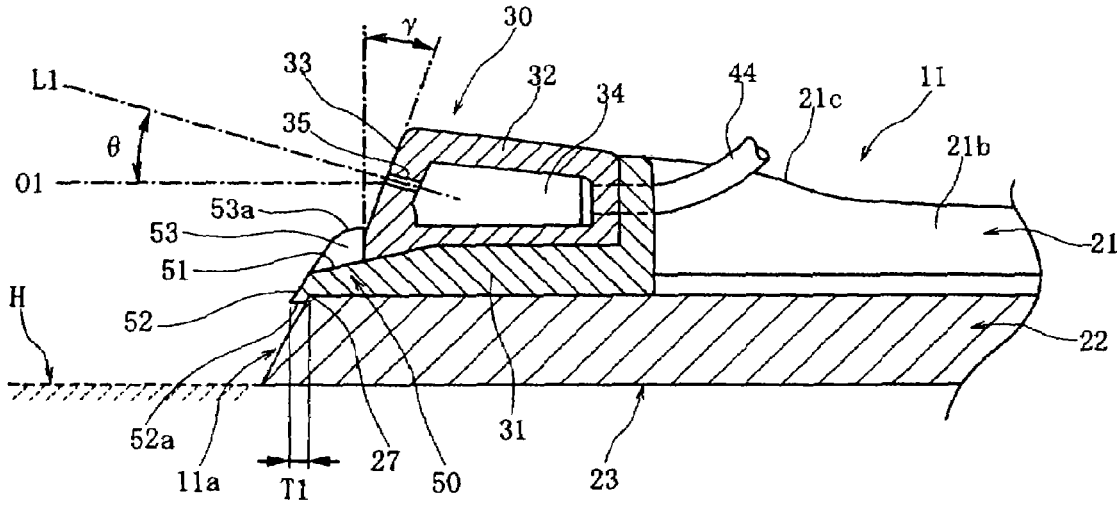
FIG. 6 is a sectional view taken along line VI-VI of FIG. 5.

FIG. 1 is a perspective view of a cleaning device 10 according to a first embodiment of the present invention; FIG. 2 is an enlarged perspective view showing a cleaning head; FIG. 3 is a perspective view showing a state where a disposable cleaning sheet is removably attached to the cleaning head; FIG. 4 is an enlarged plan view showing a liquid jetting part mounted on the cleaning head; FIG. 5 is a front view of the liquid jetting part; and FIG. 6 is a sectional view taken along line VI-VI of FIG. 5.

As shown in FIG. 1, the cleaning device 10 comprises a cleaning head 11, a shaft 13 connected to the top face of the cleaning head 11 through a universal joint 12, and a grip 14 secured on the top end of the shaft 13. In the present embodiment, the shaft 13 and the grip 14 constitute a handle 15.

As viewed from above (FIG. 2), the cleaning head 11 has a generally rectangular contour. The cleaning head 11 has a front face 11*a* along one longer side of the rectangle and a rear face 11*b* along the other longer side. Moreover, the cleaning head 11 has a right end face 11*c* along one shorter side and a left end face 11*d* along the other shorter side.

The cleaning head 11 is preferably constructed of a rigid holder 21 injection molded of a synthetic resin, such as acrylonitrile-butadiene-styrene (ABS), polyethylene (PE), polypropylene (PP), polyethylene terephthalate (PET), etc., and a pad 22 secured beneath the holder 21. The pad 22 is preferably formed of a flexible elastic material such as ethylene-vinyl acetate (EVA), a resin foam such as urethane, or rubber. Alternatively, the pad 22 may be formed of soft PP or PE. The pad 22 and the holder 21 are preferably bonded and secured together.

The bottom face of the pad 22 is referred to as cleaning part 23. The cleaning part 23 is generally flat but may be integrally formed with a number of small projections for preventing slippage of a cleaning sheet.

To the top face of the holder 21, the universal joint 12 may be connected at the midpoint between the right end face 11*c* and the left end face 11*d*. In the top face, moreover, the holder 21 has sheet retainers 24 inside four corners of the rectangle, i.e., the corner between the front face 11*a* and the right end face 11*c*, the corner between the front face 11*a* and the left end face 11*d*, the corner between the rear face 11*b* and the right end face 11*c*, and the corner between the rear face 11*b* and the left end face 11*d*. The sheet retainer 24 is preferably constructed by forming an opening 21*a* in the top face of the holder 21 and covering the opening 21*a* with a deformable sheet 25 made of PE, PP, PET, etc. The deformable sheet 25 has a cut 25*a*. FIG. 3 shows a state where a cleaning sheet 60 is retained on the cleaning head 11 such that parts of the cleaning sheet 60 are pushed into the cuts 25*a*.

As shown in FIG. 2, a liquid jetting part 30 is mounted on the holder 21. The liquid jetting part 30 is preferably located at the midpoint between the right end face 11*c* and the left end face 11*d* of the holder 21 and in front of the universal joint 12. As shown in FIG. 6, the liquid jetting part 30 may be constructed of two components: a base 31 and a nozzle head 32. The base 31 and the nozzle head 32 are preferably injection molded of a synthetic resin such as ABS, PP, PET, etc. The nozzle head 32 is preferably assembled and secured to the base 31 by means of a male-female fit, an adhesive or a screw cramp. The base 31, in turn, may be secured to the holder 21 by means of a male-female fit, an adhesive or a screw cramp.

Alternatively, the base 31 and the nozzle head 32 may be integrally formed to provide the liquid jetting part 30.

As shown in FIG. 2, the top face of the holder 21 may be recessed at the midpoint between the right end face 11*c* and the left end face 11*d* to have a recess 21*b* opening into the front face 11*a*. On both sides of the recess 21*b*, the top face of the holder 21 has steps 21*c*, 21*c* whose front faces 21*d*, 21*d* are located a distance away from the front face 11*a*.

The universal joint 12 may be connected to the holder 21 in the recess 21*b*. The liquid jetting part 30, constructed of the base 31 and the nozzle head 32, may be disposed in the recess 21*b* and located between the steps 21*c*, 21*c*. Since the nozzle head 32 is disposed such that its front face (squirt surface 33) is generally continuous with the front faces 21*d*, 21*d* of the steps 21*c*, 21*c*, the holder 21 and the liquid jetting part 30 have an integrated appearance. The nozzle head 32 thus constructed does not project much upwardly from the top face of the holder 21 and is capable of squirting liquid forwardly and outwardly from the cleaning head 11 at a position appropriately spaced from the cleaning part 23 in the height direction.

As shown in FIG. 1, the shaft 13 is provided with a container holder 41 for holding a container 42 filled with a liquid. In the embodiment of FIG. 1, the container holder 41 and the container 42 constitute a liquid retention part 40. Inside a lower part 41*a* of the container holder 41, there is provided an interrupting mechanism with a valve. The grip 14 is provided with an operating part 43 so that the valve of the interrupting mechanism can be opened by pressing the operating part 43.

When the valve is opened, liquid inside the container 42 passes through a hollow 13*a* of the shaft 13 and then through a pipe 44 under force of gravity to reach a liquid jetting chamber 34 of the nozzle head 32, as shown in FIG. 6. In the embodiment of FIG. 6, the hollow 13*a* and the pipe 44 constitute a liquid passage. Moreover, the liquid passage and the liquid retention part 40 constitute a liquid supply part.

Nozzles 35, 36, 37 have orifices on the squirt surface 33, which faces forward of the nozzle head 32. The liquid supplied to the liquid jetting chamber 34 of the nozzle head 32 can be squirted from the nozzles 35, 36, 37. When using the cleaning device 10, since the liquid retention part 40 is positioned higher than the liquid jetting part 30, as shown in FIG. 1, a pressure due to weight of liquid is applied in the liquid jetting chamber 34 of the nozzle head 32, squirting liquid forward from the nozzles 35, 36, 37.

The individual nozzles 35, 36, 37 preferably have a diameter in the range of 0.3 to 1.0 mm and linearly pierce the front panel of the nozzle head 32 to have orifices on the squirt surface 33, which is the front face of the nozzle head 32. FIGS. 4 and 6 show a squirt direction L1 of the nozzle 35, which coincides with the axis of the nozzle 35. FIG. 4 also shows a squirt direction L2 of the nozzle 36 and a squirt direction L3 of the nozzle 37.

When using the cleaning device 10, the cleaning head 11 may be moved in various directions, but in FIG. 4, a line perpendicular to the front face 11*a* of the cleaning head 11 at the midpoint between the right end face 11*c* and the left end face 11*d* is taken as a reference line O1-O2 along which the cleaning head 11 is to be moved rearward and forward during cleaning operation. In FIG. 4, the squirt direction L1 of the nozzle 35 located centrally of the squirt surface 33 coincides with the reference line O1-O2.

The squirt directions L2, L3 of nozzles 36, 37, respectively, diverge in opposite directions from the reference line O1-O2. The angle between the reference line O1-O2 and the squirt direction L2 is a squirt angle $\alpha 1$; the angle between reference line O1-O2 and the squirt direction L3 is a squirt angle $\alpha 2$.

In the plan view of FIG. 4, the squirt surface 33 is curved, preferably with a uniform radius of curvature. A tangent PL1 to the location of the squirt surface 33 where the nozzle 35 has an orifice is perpendicular or substantially perpendicular to the reference line O1-O2. Therefore, the tangent PL1 is parallel or substantially parallel to the front face 11*a* of the cleaning head 11.

As used herein, the term "substantially perpendicular" means that an angle is in the range of 80 to 100 degrees, preferably in the range of 85 to 95 degrees, while the term "substantially equal" means that difference between two angles does not exceed 10 degrees, preferably does not exceed 5 degrees.

In FIG. 4, a tangent to the location of the squirt surface 33 where the nozzle 36 has an orifice is indicated by PL2 and an opening angle formed between the tangent PL2 and an orthogonal plane perpendicular to the reference line O1-O2 is indicated by $\beta 2$ (in FIG. 4, the orthogonal plane includes the tangent PL1), while a tangent to the location where the nozzle 37 has an orifice is indicated by PL3 and an opening angle formed between the tangent PL3 and the orthogonal plane is indicated by $\beta 3$.

Figure 8:
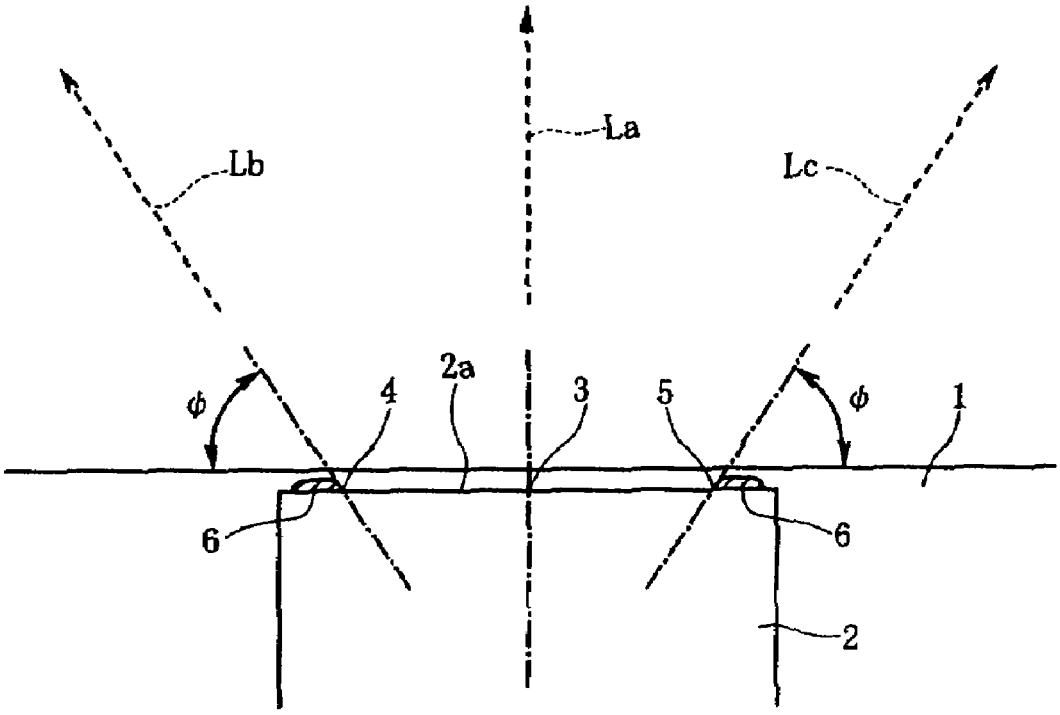
Fig. 8 PRIOR ART
FIG. 8 is a plan view for description of problems in the prior art.

Since the tangent PL2 diverges from the orthogonal plane toward the rear side O2 with distance from its intersection with PL1, the angle between the tangent PL2 and the squirt direction L2 of the nozzle 36 is not as narrow as the angle $\phi$ of FIG. 8. Since the tangent PL3 also diverges from the orthogonal plane toward the rear side O2 with distance from its intersection with PL1, the angle between the tangent PL3 and the squirt direction L3 of the nozzle 37 is not narrow.

Here, if the squirt angle $\alpha 1$ is equal or substantially equal to the opening angle $\beta 2$, the tangent PL2 is perpendicular or substantially perpendicular to the squirt direction L2 of the nozzle 36. If the squirt angle $\alpha 2$ is equal or substantially equal to the opening angle $\beta 3$, on the other hand, the tangent PL3 is perpendicular or substantially perpendicular to the squirt direction L3 of the nozzle 37. In order to make the squirt angle $\alpha 1$ equal to the opening angle $\beta 2$, the squirt direction L2 may be set to coincide with the center of curvature of a curve where the nozzle 36 has an orifice.

If the squirt angle $\alpha 1$ and the squirt angle $\alpha 2$ are equal or substantially equal to each other, moreover, liquid squirted forward from the nozzles 36, 37 can be equally supplied to both sides of the reference line O1-O2.

The squirt angles $\alpha 1$, $\alpha 2$ may be set to be, for example, 15 degrees or more and 75 degrees or less, preferably 30 degrees or more and 60 degrees or less.

FIG. 6 shows a longitudinal section of the nozzle 35. When the cleaning part 23 of the pad 22 remains stationary on a level surface H such as a floor surface, the squirt direction L1 of the nozzle 35 diverges upward from the level surface H, so that an elevation angle $\theta$ is formed between the squirt direction L1 and the level surface H. The squirt directions L2, L3 of the other nozzles 36, 37 also have the elevation angle $\theta$.

Because the squirt directions L1, L2, L3 are directed forward and upward to have the elevation angle $\theta$, the nozzles 35, 36, 37 can squirt liquid far enough forward of the cleaning head 11 to wet a satisfactory area of the surface to be cleaned. The elevation angle $\theta$ may be 5 degrees or more, preferably 15 degrees or more, and its upper limit is about 60 degrees, preferably 45 degrees.

At the location where the nozzle 35 has an orifice, as shown in FIG. 6, the squirt surface 33 diverges rearward to make an inclination angle $\gamma$ with the orthogonal plane. With the inclination angle $\gamma$, the squirt direction L1 does not make an extremely acute angle with the squirt surface 33. If the elevation angle $\theta$ is equal or substantially equal to the inclination angle $\gamma$, the squirt direction L1 is perpendicular or substantially perpendicular to the location where the nozzle 35 has an orifice.

The base 31 preferably has a liquid receiving part 50 projecting forward from beneath the squirt surface 33 of the nozzle head 32. As shown in FIG. 6, the liquid receiving part 50 has a top face 51 which is inclined to gradually come closer to the level surface H with distance toward the front side O1.

According to this embodiment, the liquid receiving part 50 has a front face 52 which is preferably parallel to the front face 11*a* of the cleaning head 11 and inclined to come closer to the level surface H with distance toward the front side O1. The front face 52 is preferably a steep slope whose inclination angle is closer to 90 degrees than the top face 51. At the front face 11*a*, the surface of the pad 22 is inclined in the same direction as the front face 52 to have an inclination angle almost equal to that of the front face 52.

As shown in FIG. 6, the front face 52 of the base 31 preferably projects a distance T1 forward of a boundary 27 between the holder 21 and the pad 22 on the front face 11*a* of the cleaning head 11. It should be noted that since the front face 52 does not project beyond the front edge of the cleaning part 23 of the pad 22, it will not hit against the furniture or the like. As shown in FIG. 5, the front face 52 also has a lower end 52*a* spaced a distance T2 downwardly from the boundary 27. The distances T1, T2 are 1 mm or more. The upper limit is not specifically set for the distances T1, T2, but may be 10 mm, for example.

On both sides of the liquid receiving part 50, the base 31 may be integrally formed with wall panels 53, 53, which rise upward from the top face 51 and have edges 53*a*, 53*a* curved to approach the level surface H.

As shown in FIG. 4, the wall panels 53, 53 may extend forward of the nozzle head 32 from laterally opposite ends of the squirt surface 33 to diverge from the reference line O1-O2 with distance toward the front side O1. That is, the distance between the wall panels 53, 53 gradually increases with distance toward the front side O1. The angle formed between each wall panel 53 and the reference line O1-O2 does not differ more than 15 degrees from the squirt angles $\alpha 1$, $\alpha 2$.

Hereinbelow, how to use the cleaning device 10 will be described.

FIG. 3 shows a state where the disposable cleaning sheet 60 is attached to the cleaning head 11. The cleaning sheet 60 has a main body 61 which is to be laid on the cleaning part 23 (the bottom face of the pad 22). In the main body 61, a nonwoven fabric is situated on one side to face the surface to be cleaned, and behind the nonwoven fabric, an absorbent layer is disposed to absorb and retain liquid. Attachment sheets 62, 62 are integrally formed to extend forward and rearward from the main body 61 of the cleaning sheet 60. The cleaning sheet 60 may be attached to the cleaning head 11 by folding back the attachment sheets 62, 62 upon the top face of the holder 21 to cover the front face 11*a* and the rear face 11*b* of the cleaning head 11 and then tucking the attachment sheets 62, 62 into the sheet retainers 24.

The attachment sheet 62 covering the front face 11*a* of the cleaning head 11 has an indentation 63 through which the squirting surface 33 of the nozzle head 32 and the liquid receiving part 50 of the base 31 can be exposed externally.

When using the cleaning device 10, as shown in FIG. 1, the main body 61 of the cleaning sheet 60, which is laid on the cleaning part 23 of the cleaning head 11, is applied to the surface to be cleaned such as a floor surface. By pressing the operating part 43 with the grip 14 being held by hand, the valve of the interrupting mechanism provided in the lower part 41*a* of the container holder 41 can be opened to permit the space above the liquid within the container 42 to communicate with the atmosphere. As a result, the liquid pressure within the liquid jetting chamber 34 of the nozzle head 32 is increased through the liquid passage in accordance with the liquid level within the container 42, and the liquid is squirted forward from the nozzles 35, 36, 37 and applied to the floor surface in front of the cleaning head 11. After the floor surface is wetted with the liquid, the cleaning head 11 is moved forward to wipe the floor with the cleaning sheet 60.

The liquid put in the container 42 may be plain water, or may contain a detergent for cleansing a floor surface, a high gloss wax, etc.

In FIG. 4, since the squirt direction L1 of the nozzle 35 extends forward along the reference line O1-O2, the nozzle 35 squirts the liquid straight forward. On the other hand, the squirt directions L2, L3 of the nozzles 36, 37 are opened at the squirt angles $\alpha 1$, $\alpha 2$ from the reference line O1-O2. Therefore, the floor surface can be widely wetted with the liquid on both sides of the reference line O1-O2.

In FIG. 4, the location of the squirt surface 33 where the nozzle 35 has an orifice (tangent PL1) is perpendicular or substantially perpendicular to the reference line O1-O2. Therefore, the liquid squirted from the nozzle 35 hardly deviates laterally from the squirt direction L1 because of wettability of the squirt surface 33 and surface tension of the liquid.

Moreover, since the location of the squirt surface 33 where the nozzle 36 has an orifice (tangent PL2) does not make an extremely acute angle with the squirt direction L2 of the nozzle 36, the liquid squirted from the nozzle 36 hardly deviates laterally from the squirt direction L2 because of wettability and surface tension or is hardly drawn by the squirt surface 33 and sprayed laterally. This is true for liquid squirted from the nozzle 37. Particularly when the squirt directions L2, L3 are perpendicular or substantially perpendicular to the tangents PL2, PL3, the nozzles 36, 37 tend to squirt liquid straight along the squirt directions L2, L3.

In FIG. 4, since the squirt surface 33 is curved with a given radius of curvature, the tangents PL1, PL2, PL3 diverge from the squirt surface 33 with distance from the orifices of the nozzles 35, 36, 37, respectively. Therefore, the liquid squirted from the nozzles 35, 36, 37 can travel straight along the squirt directions L1, L2, L3 without being drawn to the squirt surface 33.

In particular, as the remaining liquid in the container 42 decreases, the liquid pressure within the liquid jetting chamber 34 of the nozzle head 32 decreases to lower the flow rate of the liquid from the nozzles 35, 36, 37. Even in this case, the liquid squirted from the nozzles at a low flow rate can be prevented from being drawn to the squirt surface 33 and dripping on the liquid receiving part 50 of the base 31. When the valve of the interrupting mechanism is closed, furthermore, the liquid hardly oozes from the orifices of the nozzles 35, 36, 37 and adheres to the squirt surface 33 because of wettability and surface tension, so that pools such as shown in FIG. 8 will be hardly produced. Therefore, the squirt surface 33 of the nozzle head 32 and the base 31 are prevented from being excessively wetted and soiled with the detergent, the wax, etc.

As shown in FIG. 6, the squirt directions L1, L2, L3 of the nozzles 35, 36, 37 are directed forward and upward to make the elevation angle $\theta$ with the level surface H such as a floor surface to which the cleaning part 23 is to be applied, and therefore, the liquid squirted forward from the nozzle 35, 36, 37 can fly far enough to wet a satisfactory area of the surface to be cleaned. With the elevation angle $\theta$, moreover, even when the remaining liquid is decreased to lower the liquid pressure, the liquid can also fly far enough forward of the cleaning head 11 to wet a satisfactory area of the surface to be cleaned.

As shown in FIG. 6, the squirt surface 33 diverges rearward to have the inclination angle $\gamma$. Thus, even if the squirt directions L1, L2, L3 are arranged at the elevation angle $\theta$, each squirt direction does not make an extremely acute angle with the squirt surface 33 and is preferably perpendicular or substantially perpendicular to the squirt surface 33 in a section taken along a vertical plane including its nozzle axis. Accordingly, the squirt surface 33 is prevented from drawing the liquid at positions vertically adjacent to the nozzles 35, 36, 37.

In front of and below the squirt surface 33 of the nozzle head 32, the liquid receiving part 50 of the base 31 preferably extends forward. Therefore, even if the flow rate of the liquid squirted from the nozzles 35, 36, 37 is decreased and the liquid drips straight down from the nozzle orifices, the liquid can be received by the top face 51 of the liquid receiving part 50. The liquid receiving part 50 can receive the dripping liquid dripping from the nozzle orifices also in a not-in-use state where the valve of the interrupting mechanism is closed.

Furthermore, the wall panels 53, 53 are provided outside the squirt directions L2, L3 of the nozzles 36, 37 and the distance between the wall panels 53, 53 increases forward, as shown in FIG. 4. More specifically, the wall panels 53, 53 extend alongside the squirt directions L2, L3 so as not to intersect with the squirt directions L2, L3. Therefore, even if the liquid is sprayed laterally outwardly from the squirt directions L2, L3, the spread of liquid is blocked by the wall panels 53, 53. In addition, liquid adhering to the wall panels 53, 53 falls to the top face 51 of the liquid receiving part 50.

Since the top face 51 and the front face 52 in front of the top face 51 are inclined to descend forward, the liquid dripping down from the nozzles 35, 36, 37 or the liquid blocked by the wall panels 53, 53 is directed forward of the cleaning head 11 along the top face 51 and the front face 52.

This prevents the cleaning head 11 from being soiled with the detergent, the wax or the like. This also prevents accumulation of the detergent, the wax or the like in front of the nozzles 35, 36, 37 which would otherwise interfere with subsequent squirt of liquid from the nozzles.

Here, the liquid flowing down the liquid receiving part 50 may be prevented from directly dripping on the floor surface or the like by permitting the liquid to be poured on and absorbed by the interior side of the cleaning sheet 60 which faces the cleaning head 11 (see FIG. 3).

As shown in FIGS. 5 and 6, the front face 52 of the liquid receiving part 50 may be located forward of the boundary 27 and may extend downward beyond the boundary 27. Therefore, the liquid dripping from the nozzles 35, 36, 37 is prevented from adhering to the boundary 27 and spreading along the boundary 27 because of capillary action. Thus, the cleaning head 11 is prevented from being soiled with the detergent, the high gloss wax or the like.

Figure 7:
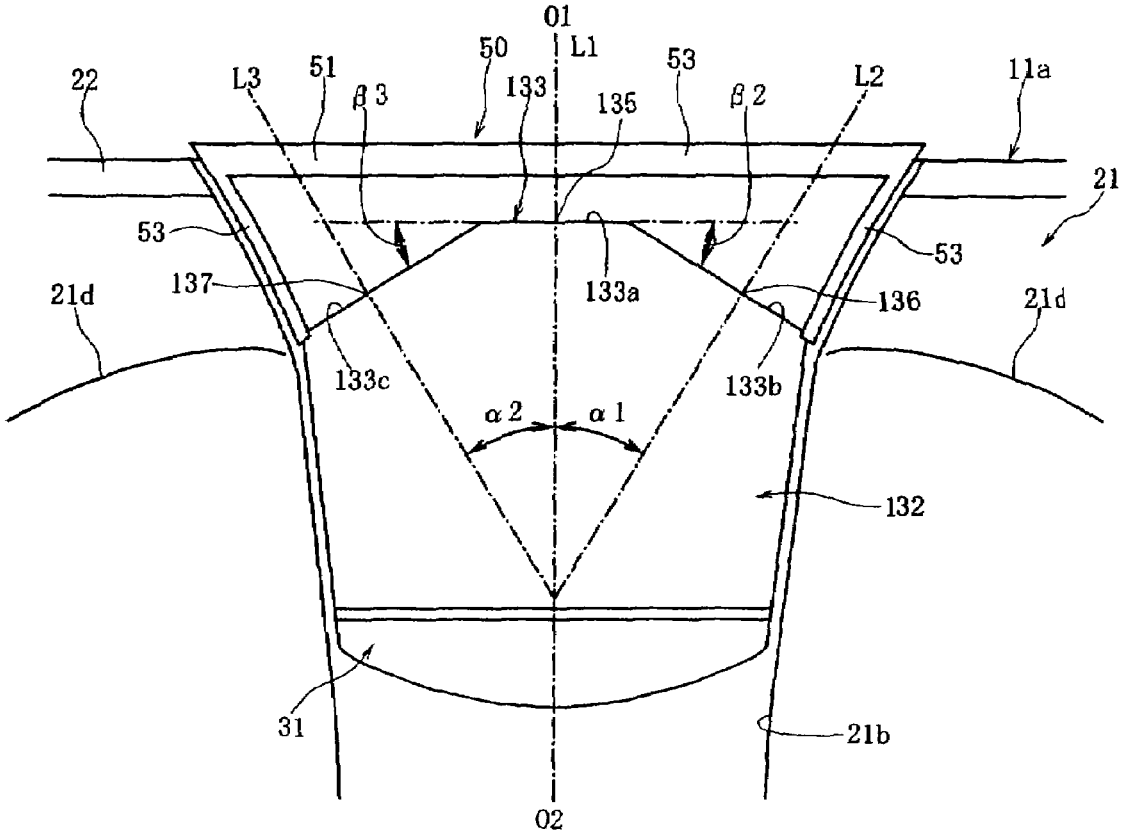
FIG. 7 is a plan view showing a liquid jetting part according to a second embodiment of the present invention.

FIG. 7 is a plan view showing a nozzle head 132 of a cleaning device according to a second embodiment of the present invention.

The nozzle head 132 has a squirt surface 133 whose contour in the plan view of FIG. 7 is different from that of the squirt surface 33 of the nozzle head 32 according to the first embodiment. The other portions have the same construction as those of the first embodiment.

In FIG. 7, the squirt surface 133 has a location 133*a* where a nozzle 135 has an orifice, a location 133*b* where a nozzle 136 has an orifice, and a location 133*c* where a nozzle 137 has an orifice. The location 133*a* is a plane perpendicular to the reference line O1-O2, the location 133*b* is a plane coinciding with the tangent PL2 of FIG. 4, and the location 133*c* is a plane coinciding with the tangent PL3 of FIG. 4. The preferred ranges of the squirt angles $\alpha 1$, $\alpha 2$ of the squirt directions L2, L3 and the opening angles $\beta 1$, $\beta 2$ of the locations 133*b*, 133*c* and the relationships between these angles are the same as those in the first embodiment of FIG. 4.

Accordingly, the second embodiment has the same effect as the first embodiment. In particular, the liquid squirted from the nozzles 135, 136, 137 tends to fly straight along the squirt directions L1, L2, L3.

In the foregoing embodiments, three nozzles are disposed in the nozzle head, but in FIG. 4, for example, the nozzle 35 may be omitted to leave only the nozzles 36, 37. Alternatively, four or more nozzles may be disposed in the nozzle head. In this case, the number of plane faces of the squirt surface 133 in the second embodiment of FIG. 7 may be changed in accordance with the number of nozzles.

The nozzle head may be located a distance above the cleaning head 11 and supported on a bracket extended upward from the cleaning head 11.

Although the present invention has been illustrated and described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the feature set out in the appended claims.

What is claimed is:

1. A cleaning device, comprising:

a cleaning head including a pad whose bottom face functions as a cleaning part, and a holder to which the pad is secured;

a handle supporting the cleaning head; and a squirter for squirting out liquid, the squirter including a liquid jetting part mounted on and attached to the holder of the cleaning head and a liquid supply part for supplying liquid to the liquid jetting part, the liquid jetting part having a nozzle for squirting out liquid in a squirt direction and beyond a front face of the cleaning head, and a liquid receiving part extending toward the front face of the cleaning head from beneath an orifice of the nozzle, wherein the liquid receiving part has a top face which is inclined to gradually approach the cleaning part with distance from the orifice of the nozzle, and integrally formed wall panels on both sides of the squirt direction of the nozzle, each rising upward from an edge of the top face and extending from a front face of the nozzle to a front face of the liquid receiving part along the edge of the top face and configured to block and direct liquid laterally sprayed from the nozzle to the top face of the liquid receiving part, the liquid receiving part comprising a lip portion extending outwardly beyond a boundary between a front face of the pad and a top portion of the pad and extending downwardly from a plane defined by the top face of the pad along the front face of the pad.

2. The cleaning device of claim 1, wherein the liquid jetting part has a plurality of nozzles fanning out to have squirt directions within an angular range, and the top face of the liquid receiving part stretches beyond the angular range of the squirt directions.

3. The cleaning device of claim 2, wherein the liquid receiving part has wall panels outside the angular range of the squirt directions, the wall panels rising upward from the top face and extending toward the front face of the cleaning head, a distance between the wall panels increasing with distance toward the front face of the cleaning head.

4. The cleaning device of claim 1, wherein the cleaning head has a holder to which the handle is attached and a pad which is secured beneath the holder to provide the cleaning part, a boundary between the holder and the pad being visible on the front face of the cleaning head, the liquid receiving part having a front face which extends beyond the boundary toward the cleaning part.

5. The cleaning device of claim 4, wherein the front face of the liquid receiving part is inclined to come closer to the cleaning part with distance from the orifice of the nozzle and projects outward from the holder.

6. The cleaning device of claim 1, wherein the liquid supply part includes a liquid retention part located above the liquid jetting part, a liquid passage connecting the liquid retention part and the liquid jetting part, and an interrupting mechanism for interrupting liquid supply from the liquid retention part to the liquid jetting part, wherein when the interrupting mechanism permits liquid passage, liquid retained in the liquid retention part squirts out of the nozzle under force of gravity.

7. The cleaning device of claim 1, wherein the cleaning head is constructed to permit removable attachment of a cleaning sheet to the cleaning part.

8. A cleaning device, comprising:

a cleaning head whose bottom face functions as a cleaning part;

a handle supporting the cleaning head; and a squirter for squirting out liquid, the squirter including a liquid jetting part mounted on the cleaning head and a liquid supply part for supplying liquid to the liquid jetting part, the liquid jetting part having a nozzle head comprising a plurality of nozzles for squirting out liquid beyond a front face of the cleaning head, each of the nozzles having an orifice provided on a front facing surface of the liquid jetting part, and a liquid receiving part extending toward the front face of the cleaning head from beneath the orifices of the nozzles, wherein the liquid receiving part has a top face which is inclined to gradually approach the cleaning part with distance from the orifices of the nozzles and integrally formed wall panels on both sides of the squirt direction of the nozzles, the wall panels each rising upward from an edge of the top face and extending from a front face of the nozzle head to a front face of the liquid receiving part along the edge of the top face, the wall panels being configured to block and direct liquid laterally sprayed from the nozzle head to the top face of the liquid receiving part, the liquid receiving part comprising a lip portion extending outwardly beyond a boundary between a front face of the pad and a top portion of the pad and extending downwardly from a plane defined by the top face of the pad along the front face of the pad, wherein the nozzles are adapted to squirt liquid in diverging squirt directions, which are substantially perpendicular to tangent planes of the front facing surface of the liquid jetting part at the orifices of the nozzles, respectively.

9. A cleaning device, comprising a handle and a cleaning head connected to the handle, the cleaning head comprising:

a pad having a cleaning surface and mounted on a holder;

a liquid jetting part comprising a base and a nozzle head, the liquid jetting part being secured to a recess formed on a top face of the holder at the midpoint between a right end face and a left end face of the holder by a male-female fit, the nozzle head being secured to the base by a male-female fit, and the nozzle head having a plurality of orifices fanning out from a squirt surface of the nozzle head, wherein the base comprises a liquid receiving part extending from beneath the orifices of the nozzle head toward a front face of the cleaning head, the liquid receiving part has a top face inclined to gradually approach a plane formed along the cleaning surface of the pad with distance from the orifices of the nozzle head, and two wall panels, which are formed integrally with the top face, arising from two laterally opposite edges of the top face and extending from two laterally opposite sides of the nozzle head toward a front face of a liquid receiving part, the liquid receiving part comprising a lip portion extending outwardly beyond a boundary between a front face of the pad and a top portion of the pad and extending downwardly from a plane defined by the top face of the pad along the front face of the pad;

wherein the wall panels being configured to block and direct liquid laterally sprayed from the nozzle head to the top face of the liquid receiving part.

10. The cleaning device of claim 9, wherein the orifices of the nozzle head have longitudinal axes having an elevation angle of 15-60° from a plane parallel to the cleaning surface of the pad; and longitudinal axes of at least two of the plurality of orifices diverge from a plane orthogonal to the front face of the cleaning head as to form a squirt angle of 30-60°.

11. A cleaning device, comprising a handle and a cleaning head connected to the handle, the cleaning head comprising:

a pad having a cleaning surface and mounted to a holder;

a liquid jetting part comprising a base and a nozzle head, the liquid jetting part being secured to a recess formed on a top face of the holder at a midpoint between a right end face and a left end face of the holder by a male-female fit, the nozzle head being secured to the base by a male-female fit, and the nozzle head having a plurality of orifices fanning out from a squirt surface of the nozzle head, wherein the base comprises a liquid receiving part extending from beneath the orifices of the nozzle head toward a front face of the cleaning head, the liquid receiving part has a top face inclined to gradually approach a plane formed along the cleaning surface of the pad with distance from the orifices of the nozzle head, and two wall panels are formed integrally with the top face of the liquid receiving part and are configured to block and direct liquid laterally sprayed from the nozzle head to the top face of the liquid receiving part, the two wall panels arising from two laterally opposite edges of the top face and extending the length of the liquid receiving part from the nozzle head to a front face of the liquid receiving part, the liquid receiving part comprising a lip portion extending outwardly beyond a boundary between a front face of the pad and a top portion of the pad and extending downwardly from a plane defined by the top face of the pad along the front face of the pad.

12. The cleaning device of claim 11, wherein the orifices of the nozzle head have longitudinal axes having an elevation angle of 15-60° from a plane parallel to the cleaning surface of the pad; and longitudinal axes of at least two of the plurality of orifices diverge from a plane orthogonal to the front face of the cleaning head as to form a squirt angle of 30-60°.

* * * * *